US005383817A

United States Patent [19]

McCormick

[11] Patent Number: 5,383,817

[45] Date of Patent: Jan. 24, 1995

[54] MULTIPLE PLY PAPER ROLL

[75] Inventor: Joseph A. McCormick, Manhattan, Ill.

[73] Assignee: General Credit Forms, Incorporated, Earth City, Mo.

[21] Appl. No.: 214,008

[22] Filed: Mar. 14, 1994

Related U.S. Application Data

[63] Continuation of Ser. No. 873,451, Apr. 24, 1992, abandoned.

[51] Int. Cl.[6] ..... B41L 1/20

[52] U.S. Cl. ..... 462/25; 462/26

[58] Field of Search ..... 462/25, 26; 281/2, 5; 428/40–43

[56] References Cited

U.S. PATENT DOCUMENTS

| | | | |
|---|---|---|---|
| 543,330 | 7/1895 | Breakspear | 462/25 |
| 3,877,728 | 4/1975 | Herz | 281/5 X |
| 4,357,380 | 11/1982 | Schnug | 281/5 X |

FOREIGN PATENT DOCUMENTS

| | | | |
|---|---|---|---|
| 1055426 | 2/1954 | France | 462/26 |
| 8501916 | 5/1985 | WIPO | 462/26 |
| 8607314 | 12/1986 | WIPO | 462/26 |

*Primary Examiner*—Willmon Fridie

*Attorney, Agent, or Firm*—Marshall, O'Toole, Gerstein, Murray & Borun

[57] ABSTRACT

The invention encompasses multiple-ply carbonless paper rolls having the plies adhesively joined along at least one edge of the roll. Advantageously, the individual plies remain adhered together when the plies are unwound and separated from the main roll but are still relatively easy to separate from each other.

8 Claims, 1 Drawing Sheet

MULTIPLE PLY PAPER ROLL

This is a continuation of U.S. application Ser. No. 07/873,451, filed Apr. 24, 1992, now abandoned.

FIELD OF THE INVENTION

The invention is generally directed to a small paper roll defining at least one imprintable form typically used to record retail sales transactions comprising multiple layered plies. More specifically, the invention encompasses a small paper roll having two or more stacked or layered carbonless paper plies adhesively joined along at least one longitudinal edge of the roll so that portions of the multiple plies may be kept together and properly aligned after being separated from the main paper roll.

BACKGROUND OF THE INVENTION

Carbonless, multiple ply business forms generally include a number of plies that provide a desired number of copies of the form. For two-ply forms, the top ply is most often a coated back ("CB") paper and the adjacent underlying ply is a coated front ("CF") paper. In such a two-ply form, the coated back paper is treated with a carbonless coating that contains rupturable microcapsules that are filled with reactive, colorless dyes. The coated front paper is treated with a resin adapted to react with the colorless dyes. When the microcapsules are ruptured to allow contact of the colorless reactive dye with the resin, a color changing reaction occurs that produces an image on the coated front sheet of the underlying ply.

For a three-ply form, the top ply is a coated back ply, the adjacent underlying ply is a coated front and back ("CFB") ply, and the bottom ply is a coated front ply. In the three-ply form, the middle ply is coated on both opposing surfaces such that the coated front allows images to be made on the middle ply and the coated back allows copies of such images to be made on the coated front bottom ply.

Forms having more than three plies are readily made by adding intermediate coated front and back plies to the form. For example, in a four-sheet form, the top ply is a coated back ply, two intermediate plies are coated front and back plies, and the bottom ply is a coated front ply.

For convenience, the multiple plies of forms are generally adhered together along a single longitudinal edge of the plies. The adhesion of the plies to each other is accomplished using liquid adhesive compositions, conventionally referred to as "padding compounds," which selectively adhere only to surfaces coated with carbonless image producing compounds, allowing such surfaces to adhere to each other but not to surfaces which are free of such coatings. In some instances, an adhesive rejection solution is disposed over the top surface of the coated bottom ply and the bottom surface of a coated front ply to assure that the padding compound does not adhere to such surfaces.

This property of selective adhesion allows manufacturers to bond or edge-pad (join sheets together along one edge) a large stack of sheets which have been collated to give a desired form. For example, the two sheets that are used to make a two-sheet form are collated into a stack having, from top to bottom, a coated back sheet, a coated front sheet, a coated back sheet, a coated front sheet, and so on. In this collated stack of two-sheet forms, the liquid adhesive composition only bonds a coated back sheet to the adjacent underlying coated front sheet. No bond is formed between the coated back sheet and the overlying coated front sheet in the collated stack. Thus, the liquid adhesive composition may be applied to one edge of the entire collated stack and when the stack is dried and then fanned out, the stack spontaneously separates into individual two-sheet forms, each form being adhesively bonded together at one edge.

In such conventional, carbonless multiple-ply forms, however, each sheet is cut to its final size and shape before the sheets in each form are adhesively joined. Thus, such forms are not readily adapted to recordation or imprinting systems which produce variable sized or shaped forms or copies.

One common continuous feed imprinting system that produces variable sized and shaped forms or copies from a common feedstock is a "point of sale" imprinting system. Retail sales transactions using credit cards are typically recorded on continuously fed two-ply carbonless paper rolls using standardized imprinting equipment. A two-ply carbonless paper roll having one ply stacked or layered on the other ply readily provides two copies of the sale.

Specifically, in a "point of sale" transaction, a customer's credit card having a magnetic information strip is passed through a magnetic reader. Information from the credit card's magnetic strip, such as the customer's name, account number, card expiration date, etc., is read from the magnetic strip and this information is then imprinted onto a multiple-ply carbonless paper roll. At the same time, additional information related to the specific sale, such as merchant's name, items purchased, price, etc., is also imprinted onto the paper roll. After all of the needed information is imprinted and each ply of the paper roll contains a copy thereof, a sales clerk separates the imprinted portion of the paper roll from the rest of the main paper roll. The separated, imprinted portion of the roll, which varies in length from sale to sale, is presented to the customer for signature, then the two imprinted portions are separated and separate copies containing complete copies of the imprinted statement are retained by the sales clerk and the customer, respectively.

In conventional two-ply carbonless paper rolls, the two parts making up the roll are not attached or joined together. Accordingly, as the imprinted portions are separated from the main paper roll, the sales clerk and/or the customer must ensure that both imprinted portions that are separated from the paper roll remain properly aligned when the customer signs the imprinted portion.

In order to provide satisfactory imprinted copies of the sales transaction to both the merchant and customer, it is important that the imprinted portion remain together until it is signed by the customer. It has been found, however, that the small size of the imprinted portions, which have a length of about six inches, and the manual handling of the imprinted portions by the sales clerk and customer interfere with the proper alignment of the imprinted portions.

A need exists for a multiple ply carbonless paper roll which maintains the multiple plies of the roll in proper register when an imprinted portion is separated from the paper roll. Moreover, once copies of the sales transaction are imprinted on those portions of the plies and the imprinted portions are separated from the main paper roll, the plies should be readily and conveniently separable from each other after the customer signature is affixed so that separate copies may be available for retention by both the merchant and the customer.

SUMMARY OF THE INVENTION

It is an object of the invention to overcome one or more of the problems described above.

According to the invention, a multiple ply paper roll includes at least top and bottom plies with the top ply disposed over and in register with the bottom ply along respective longitudinal edges of the plies when the plies are wound onto a roll and printed (and/or imprinted). Each of the plies has upper and lower opposing surfaces with the lower surface of the top ply and the upper surface of the bottom ply being coated with carbonless image producing agents. Any intermediate plies disposed between the top and bottom plies are coated on both upper and lower surfaces of the plies.

At least one of the upper surface of the top ply and the lower surface of the bottom ply are free of such carbonless image producing agents and in some cases have a clear padding compound rejection solution applied to these surfaces.

The roll further includes an adhesive adapted to releasably join the chemically coated carbonless surfaces to each other, but not to surfaces which are free of such carbonless coating, along at least one longitudinal edge of the plies.

Preferably, the first and second plies are adhesively joined along only one of the two edges of the roll.

Other objects and advantages of the invention will be apparent to those skilled in the art from a review of the following detailed description taken in conjunction with the drawings and the appended claims.

DETAILED DESCRIPTION OF THE INVENTION

Figure 1:
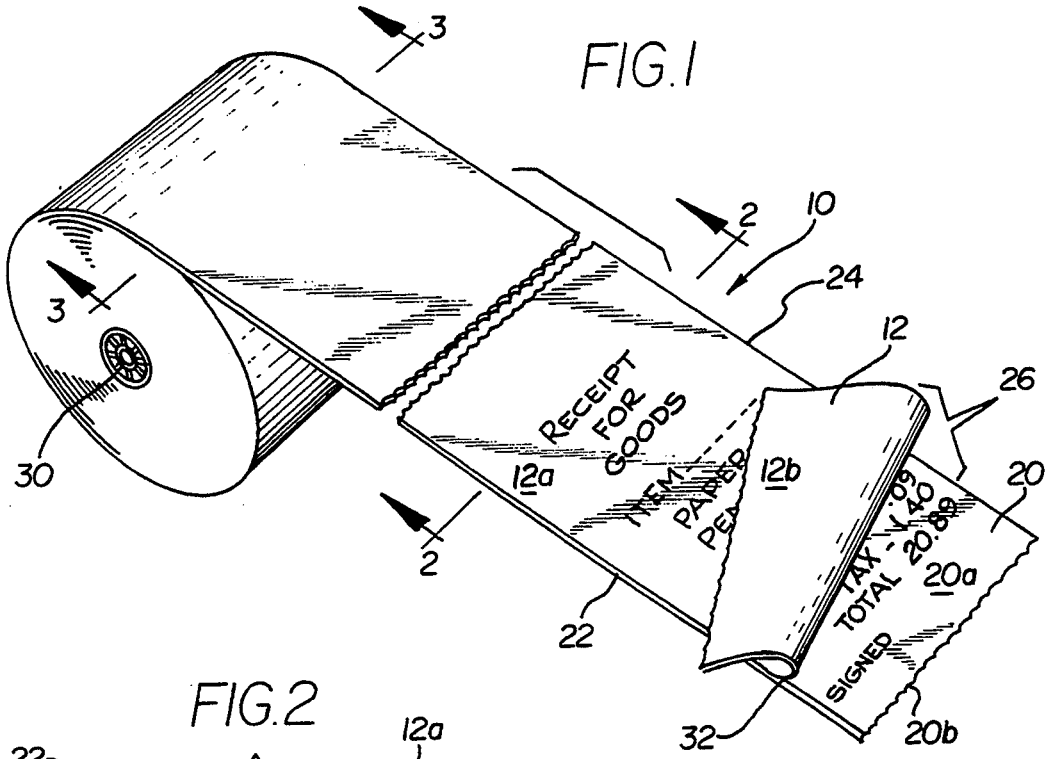
FIG. 1 is a perspective view of a two-ply carbonless paper roll of the invention in which a top and a bottom ply are joined to each other along one of the two longitudinal edges of the roll.

The invention provides a multiple-ply carbonless paper roll suitable for use in point of sale imprinting equipment. As illustrated in FIG. 1, a two-ply carbonless paper roll, generally designated 10, includes a top ply 12 defining respective upper and lower surfaces 12*a* and 12*b* overlying and in register with a bottom ply 20, which defines respective upper and lower surfaces 20*a* and 20*b*. The rolls generally are approximately 3 inches wide with the outside diameter of a wound roll being approximately 2½ to 3½ inches. It is appreciated that the size of the roll can vary depending upon a particular application. The plies 12 and 20 are releasably joined along a longitudinal edge 22 of the roll 10 but, in this particular embodiment, the plies are not joined along a second longitudinal edge 24. Together, the plies 12 and 20 define an imprintable form, generally designated 26. The plies 12 and 20 are wound about a core, illustratively a plastic or fiber spool 30.

Figure 2:
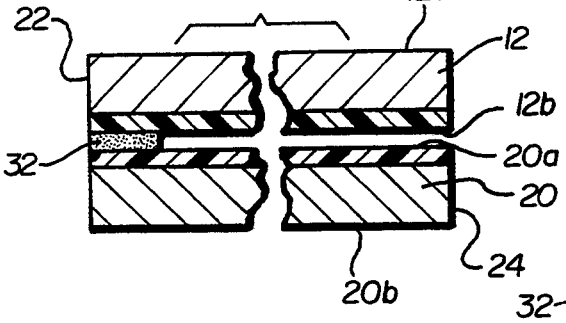
FIG. 2 is a sectional view of the two-ply carbonless paper roll of FIG. 1 taken along section lines 2—2 of FIG. 1.

As illustrated in FIG. 2, the surfaces 12*b* and 20*a* are coated with carbonless chemical image producing agents (described below) and the surfaces 12*a* and 20*b* are free of such carbonless coatings. The top ply 12 is adhesively joined to the bottom ply 20 with a small amount of an adhesive 32 along the edge 22. As seen in FIG. 2, for example, the thin layer of adhesive extends inwardly from the edge 22 toward the middle of the plies 12, 20 far enough for the plies 12 and 20 to be joined together but still being capable of being readily separated by pulling the top ply 12 from the bottom ply 20. Preferably, the adhesive penetrates from the edge 22 inwardly between about 1/64 to 1/32 inch. It is preferable to have the least amount of inward penetration of the adhesive as possible, while at the same time having a form 26 which will be satisfactorily releasably joined along edges 22.

Figure 3:
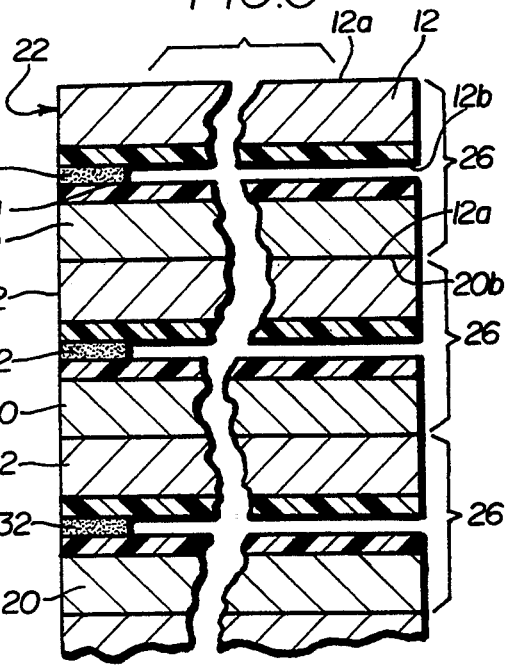
FIG. 3 is an edge view of the two-ply carbonless paper roll of FIG. 1 taken along section lines 3—3 of FIG. 1.

As illustrated in FIG. 3, when the plies 12 and 20 are wound into the roll 10, the two plies 12 and 20 form alternating layers with the top ply 12 being the outermost or top layer. The bottom ply 20 lies directly underneath the top ply 12 and is also disposed over the next underlying top ply 12. This pattern repeats itself throughout the roll 10.

Beginning with the uppermost top ply 12, there is a small amount of adhesive 32 disposed along the edge 22 between the lower surface 12*b* of each top ply 12 and the upper surface 20*a* of each bottom ply 20. Notably, there is no layer of adhesive between the lower surface 20*b* of each bottom ply 20 and the adjacent upper surface 12*a* of each top ply 12. Accordingly, the plies 12 and 20 are readily unwound together from the roll 10, but the adhesive 32 keeps each top ply 12 joined to a bottom ply 20 when such plies are separated from the roll.

Figure 4:
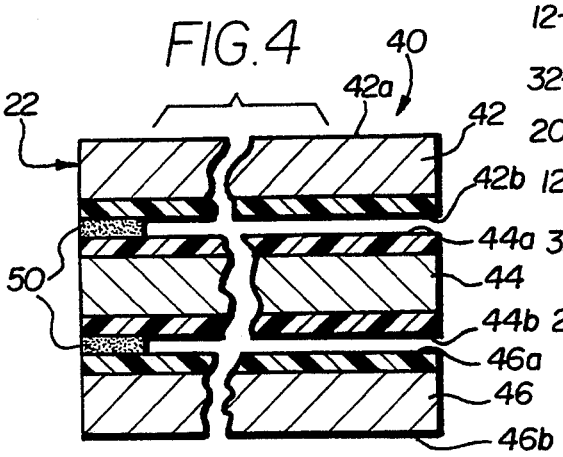
FIG. 4 is a sectional view of a three-ply form of a carbonless paper roll of the invention.

An embodiment of the invention having three plies is illustrated in FIG. 4. Referring to FIG. 4, a three-ply roll 40 includes three carbonless paper plies 42, 44 and 46 each of which defines upper and lower surfaces 42*a* and 42*b*, 44*a* and 44*b*, and 46*a* and 46*b*, respectively. The top ply 42 is preferably a coated back ply disposed over the intermediate ply 44, which is a coated front and back ply disposed over the bottom ply 46, which, in turn, is a coated front ply. A layer of adhesive 50 releasably joins intermediate ply 44 to both the top ply 42 and bottom ply 46. Adhesive 50 extends inwardly from edge 22 between surfaces 42*b* and 44*a* and between surfaces 44*b* and 46*a* toward the middle of the plies far enough for the plies 42, 44 and 46 to be joined together but still remain capable of being readily separated by pulling one ply away from another ply. Preferably, adhesive 50 penetrates from edge 22 inwardly between about 1/64 to 1/32 inch. Notably, when the three plies are wound onto a roll, there is no adhesive bond between the lower surface 46*b* of the bottom ply 46 and the upper surface 42*a* of the adjacent intermediate ply 42. Thus, the three plies may be easily unwound from the roll 40 but the layer of adhesive 50 keeps the plies 42, 44 and 46 joined when a portion of the plies is separated from the roll 40.

According to the invention, the plies 12, 20, 42, 44 and 46 are so-called carbonless paper plies. Carbonless papers are papers coated with carbonless image producing agents. The phrase "carbonless image producing agents," as used herein, includes any system of colorless dyes that chemically react to form a color when placed in contact with a reactive agent. Such carbonless image producing agents generally comprise a two-part system. One part of such a system includes chemically reactive, colorless dyes which are contained in rupturable microcapsules. The other part of such a system includes a coatable reactive resin which reacts on contact with the colorless dye to develop a visible color. To produce an image with such a two-part system, a surface of a first paper is coated with the microencapsulated colorless dyes while a surface of a second paper is coated with the reactive resin. To produce an image, the coated surfaces of the first and second papers are brought together and pressure sufficient to rupture the microcapsules is applied. When the microcapsules rupture, the colorless dyes are released and react with the reactive resin to form an image on the surface of the resin coated paper.

Conventionally, the bottom surfaces of CB paper are coated with the microencapsulated colorless dyes, and the top surfaces of CF paper are coated with the reactive resin. In addition, CFB paper is coated on one surface with the reactive resin and on the opposing surface with the microencapsulated dyes.

Carbonless papers coated with such carbonless image producing agents that are suitable for use in the present invention are described in U.S. Pat. No. 3,981,523, for example, the disclosure of which is incorporated herein. Other commercially available carbonless papers are sold under the trademark NCR PAPER ®, by Appleton Paper Inc. of Appleton, Wis. Compatible carbonless papers are also produced by other manufacturers such as Moore Business Forms, 3M, Mead Paper and others.

Useful adhesives include liquid adhesive compositions commonly used to edge-pad collated stacks of carbonless paper. Such liquid adhesive compositions are generally aqueous compositions which include a water-based latex adhesive polymer, a glycol and an alcohol. Suitable latex adhesives include poly (ethylacrylate/-methacrylate), poly(ethylacrylate/N-methlolacrylamide) and poly(ethylene/vinyl acetate). Such liquid adhesive compositions are described in U.S. Pat. No. 5,079,068 issued Jan. 2, 1992 as well as in International application PCT/US91/04760 published Jan. 23, 1992, the disclosures of which are incorporated by reference herein. Commercially available liquid adhesive compositions include: MEAD FAN-APART ADHESIVE marketed by the Fine Paper Division of Mead Paper Corporation (Chillicothe, Ohio), FANAPART HIGH STRENGTH PADDING ADHESIVE marketed by Appleton Papers, Incorporated (Appleton, Wis.) and FAN-OUT PADDING ADHESIVE marketed by 3M (St. Paul, Minn.).

EXAMPLE

The following example describes a two-ply padded paper roll in accordance with the invention.

This example provides a two-ply carbonless paper roll suitable for use in standardized point of sale imprinting equipment. According to well known procedures, a large roll of coated back (CB) white 14.3 lb paper stock (approximately 50" wide×40" outside diameter) sold by Appleton/NCR, Appleton, Wis. and a large roll of coated front (CF) canary 13.5 lb paper stock (approximately 50" wide×40" outside diameter) sold by Appleton/NCR, Appleton, Wis. were both slit and rewound onto 7/16 inch plastic spools using slitter/-rewinder equipment manufactured and sold by Jennerjahn (Indiana) to form approximately three (3) inch wide small paper rolls having the white CB paper ply disposed on top of and in register with the canary CF paper ply. Each small roll contained approximately 100 feet of both white and canary paper and is approximately three (3) inches in diameter.

The rewound rolls were removed from the slitter/-rewinder equipment and one flatside edge of each rewound roll was contacted with a sponge soaked in a liquid adhesive composition sold as FAN-OUT PADDING ADHESIVE, by 3M Company (St. Paul, Minn.). The liquid adhesive composition is believed to have the following composition:

| FAN-OUT PADDING ADHESIVE | |
|---|---|
| Component | WT. % |
| poly(vinyl acetate) stabilized with surfactant | 9 |
| poly(vinyl alcohol) | 4.5 |
| ethyl alcohol | 28 |
| crystalline sorbitol, 4000 NF | 1.25 |
| water | 57.25 |

Each (white/canary) small roll was contacted with the soaked sponge for about two seconds on one flatside edge, which is the edge of the roll formed by the edges 22 of individual, overlapped plies, using moderate pressure and slight rotation to ensure adequate, uniform contact of the edge of the roll with the liquid adhesive composition. The liquid adhesive composition penetrated into the roll approximately 1/64 to 1/32 inch. After contact with the liquid adhesive composition, the paper rolls were dried, adhesive treated edge up, for about 15–20 minutes after which it can be boxed for shipping.

If desired, the liquid adhesive padding compound can be applied by any number of methods aside from the sponge contact method. For example, the padding compound can be applied by a paint brush or it can be sprayed onto the flatside edge.

Similarly, while the invention has been illustrated with adhesive 32, 50 contacting the various plies along edge 22, it is appreciated that, if desired, the remaining edge 24 could have padding compound applied to it so that plies 12 and 20, for example, were releasably joined along edges 22 and 24.

The foregoing detailed description has been given for clearness of understanding only, and no unnecessary limitation would be understood therefrom as modifications with the scope of the invention will be apparent to those skilled in the art.

I claim:

1. A roll comprising at least one imprintable form, each said form comprising:

(a) a top ply and a bottom ply, each of said top and bottom plies defining at least one longitudinal edge in register with a corresponding longitudinal edge of the other top or bottom ply, said top ply being disposed over said bottom ply, and each of said top and bottom plies defining respective upper and lower surfaces;

(b) said top ply lower surface and said bottom ply upper surface being coated with a carbonless image producing agent;

(c) said top ply upper surface and said bottom ply lower surface being free of carbonless image producing agent; and, (d) means for releasably adhering said lower coated surface of said top ply to an adjacent upper coated surface of said bottom ply along at least said longitudinal edge of said top and bottom plies without adhering a coated ply surface to an adjacent ply surface which is free of carbonless image producing agent;

whereby said form having said releasably joined top and bottom plies can be unwound from said roll without the form adhering to said remaining portion of said roll.

2. The roll of claim 1 wherein each said top ply, bottom ply, and any intermediate ply defines two longitudinal edges in register with corresponding longitudinal edges of the other plies in said roll, each said coated ply surface being releasably adhered to an adjacent coated ply surface along both of said longitudinal ply edges without adhering a coated ply surface to an adjacent ply surface which is without carbonless image producing agent thereon.

3. The roll of claim 1 or 2 comprising a plurality of said imprintable forms stacked in superimposed relation to one another and wound in the form of said roll.

4. The roll of claim 1 or 2 wherein said adhesive means comprises a liquid adhesive applied to said longitudinal edge of said roll.

5. The roll of claim 4 wherein said plies each include two spaced longitudinal edges and both said longitudinal edges are contacted by said adhesive means.

6. The roll of claim 1 or 2 wherein said roll is between $2\frac{1}{2}$–$3\frac{1}{2}$ inches wide and having an outside diameter of between 2–3 inches.

7. The roll of claim 1 or 2 wherein said adhesive means extends inwardly from said longitudinal edge approximately 1/32 to 1/64 inch.

8. The roll of claim 1 wherein said roll includes three plies releasably glued, one ply to another ply, along one edge of each of said plies.

* * * * *